US006542865B1

(12) United States Patent
Nagao et al.

(10) Patent No.: US 6,542,865 B1
(45) Date of Patent: Apr. 1, 2003

(54) METHOD AND APPARATUS FOR SUBBAND CODING, ALLOCATING AVAILABLE FRAME BITS BASED ON CHANGABLE SUBBAND WEIGHTS

(75) Inventors: Fumiaki Nagao, Gifu (JP); Masato Fuma, Ichinomiya (JP); Miyuki Okamoto, Hashima (JP)

(73) Assignee: Sanyo Electric Co., Ltd. (JP)

( * ) Notice: Subject to any disclaimer, the term of this patent is extended or adjusted under 35 U.S.C. 154(b) by 0 days.

(21) Appl. No.: 09/252,501

(22) Filed: Feb. 18, 1999

(30) Foreign Application Priority Data

Feb. 19, 1998 (JP) ..... 10-037347

(51) Int. Cl.[7] ..... G10L 19/02
(52) U.S. Cl. ..... 704/229; 704/200.1
(58) Field of Search ..... 704/200.1, 229

(56) References Cited

U.S. PATENT DOCUMENTS 5,469,474 A * 11/1995 Kitabatake ..... 375/243
5,623,577 A * 4/1997 Fiedler ..... 704/200.1
5,634,082 A * 5/1997 Shimoyoshi et al. .... 704/200.1
5,737,721 A * 4/1998 Kwon ..... 704/229
5,956,674 A * 9/1999 Smyth et al. ..... 704/229

* cited by examiner

*Primary Examiner*—Tālivaldis Ivars Šmits
(74) *Attorney, Agent, or Firm*—Cantor & Colburn LLP

(57) ABSTRACT

A method according to the present invention generates weight data for each audio band and assigns a number of bits to each band according to the weight data. The method then calculates a total of the numbers of bits of one block and compares the total with an upper limit and with a lower limit of a compression target value. Based on the comparison result, the method increases or decreases the value of the weight data to update it. The method reassigns a number of bits based on the updated weight data.

7 Claims, 6 Drawing Sheets

| WEIGHT DATA gm(n) | NUMBER-OF-BITS DATA Wm(n) |
|---|---|
| 15 ~ 12 | 3 |
| 11 ~ 8 | 2 |
| 7 ~ 4 | 1 |
| 3 ~ 0 | 0 |

Fig. 2

| | WEIGHT DATA | | | | NUMBER-OF-BITS DATA | | | |
|---|---|---|---|---|---|---|---|---|
| | $g_1$ | $g_2$ | $g_3$ | $g_4$ | $W_1$ | $W_2$ | $W_3$ | $W_4$ |
| INITIAL VALUE | 4 | 5 | 9 | 10 | 1 | 1 | 2 | 2 |
| SUBTRACT 1 FROM WEIGHT DATA | 3 | 4 | 8 | 9 | 0 | 1 | 2 | 2 |
| SUBTRACT 1 FROM NUMBER-OF-BITS DATA | - | - | - | - | 0 | 0 | 1 | 1 |

Fig. 3

METHOD AND APPARATUS FOR SUBBAND CODING, ALLOCATING AVAILABLE FRAME BITS BASED ON CHANGABLE SUBBAND WEIGHTS

BACKGROUND OF THE INVENTION

1. Field of the Invention

The present invention relates to a coding method for coding digital data broken down into a plurality of components and a digital data coding apparatus for performing the coding method.

2. Description of the Related Art

Data to be processed in a digital audio unit is recorded in a compressed form to allow more data to be recorded on a recording medium. To compress data, time-series audio data is converted to data on the frequency axis, then divided into a plurality of blocks according to the frequency. This digital audio data of each block is coded in accordance with a number of bits assigned to each block. Usually, a larger number of bits are assigned to a lower frequency block.

FIG. 7 is a block diagram showing the configuration of a coding apparatus for coding digital data. Input data X(n) is obtained by performing Fourier transformation on audio data with the result then plotted on the frequency axis. FIG. 8 shows an example. In FIG. 8, one block of data is divided into eight bands: B1 to B8. For each band of data X(n), there are two hearing levels: one is the lowest audible level L1 at which humans can hear a sound and the masking level L2 at which humans cannot hear a sound because the sound is masked by another sound. Humans can hear only the sounds exceeding both levels L1 and L2. A coding apparatus assigns a specific number of bits to each of bands, B1 to B8, according to the lowest audible level L1 or the masking level L2, whichever is higher, and the difference between the signal level L0 of each band (B1 to B8). This makes it possible to compress audio data X(n) without deterioration of the quality of the sound when it is played back later.

Data X(n) is stored continuously to a register 1, one block at a time, and is read from it, as band data Am(n)representing the level of each band in the block. A number-of-bits data generation circuit 2 assigns a number of bits according to the content of band data Am(n) and generates number-of-bits data Wm(n) specifying the number of bits for coding band data Am(n). The value of this number-of-bits data Wm(n) depends on the difference between the lowest audible level L1 or the masking level L2, whichever is higher, and the signal level L0 of each band (B1 to B8). That is, the value is small for a band whose difference is small; the value is large for a band whose difference is large.

When coding band data Am(n), a correction data generation circuit 3 calculates the total number of bits required for a block based on number-of-bits data Wm(n). Then, based on the difference between the calculated total number of bits and the target number of bits, the correction circuit calculates how many bits must be reduced to keep the total number of bits of a block below a desired number of bits. The correction circuit generates correction data C(n) representing the number of bits to be reduced from the number-of-bits data Wm(n). Based on the correction data C(n), a number-of-bits data correction circuit 4 corrects the number-of-bits data Wm(n) which was output from the number-of-bits data generation circuit 2 and generates number-of-correction-bits data wm(n).

A coding circuit 5 codes the band data Am(n) read from register 1 according to the number-of-correction-bits data wm(n) and generates compressed data Y(n) whose number of bits has been reduced. That is, the compressed data Y(n) output from the coding circuit 5 is created based on the number-of-correction-bits data wm(n) corrected by the correction data C(n). Thus, the number of bits of the compressed data Y(n) is smaller than the target number of bits of a block.

When the total number of bits of a block exceeds the target number of bits, the above coding apparatus reduces one bit from each of bands, B1 to B8. This means that, when one bit is reduced from each of bands B1 to B8, a total of eight bits are reduced. The difference between the total number of bits and the target number of bits becomes too large. For example, even when the total number of bits is only one bit larger than the target number of bits, one bit is reduced from each of bands B1 to B8. This results in the total number of bits being seven bits less than the target number of bits; these seven bits, although available for use for coding, are not used. The likelihood that these wasteful bits will be generated increases along with the number of bands.

SUMMARY OF THE INVENTION

The present invention reduces the number of wasted bits and makes the number of bits as close to the target number of bits as possible.

There is provided a digital data coding method for coding one block of digital data at a time, in which each block is composed of a plurality of digital data values and each digital data value represents a value of a corresponding component. The digital data coding method comprises: a first step for calculating specific weight data for each component; a second step for assigning a number of bits to each component according to the weight data; a third step for calculating a total value of the number of bits of one block, the number of bits being assigned in the second step; a fourth step for comparing between the total value of the number of bits of one block calculated in the third step with a predetermined aim value; and a fifth step for increasing or decreasing the weight data calculated in the first step according to the comparison in the fourth step, wherein by repeating the first step to the fifth step, the total number of bits of one block is converged into a predetermined range.

According to the present invention, weight data and the number of bits representing the number of bits of data to be coded are independent of each other. This makes it possible to use more bits to represent the weight data than to represent the number of bits used to represent the number of bits of data to be coded, thus allowing the weight data to be increased or decreased more flexibly than the number of bits. Therefore, by assigning the number of bits based on the weight data, the number of bits may be selectively increased or decreased for each band.

BRIEF DESCRIPTION OF THE DRAWINGS

FIG. 2 is a diagram showing an example of a conversion table for converting weight data to the number of bits.

FIG. 3 is a diagram showing the relation between weight data used during coding and the number of bits.

DESCRIPTION OF PREFERRED EMBODIMENTS

Figure 1:
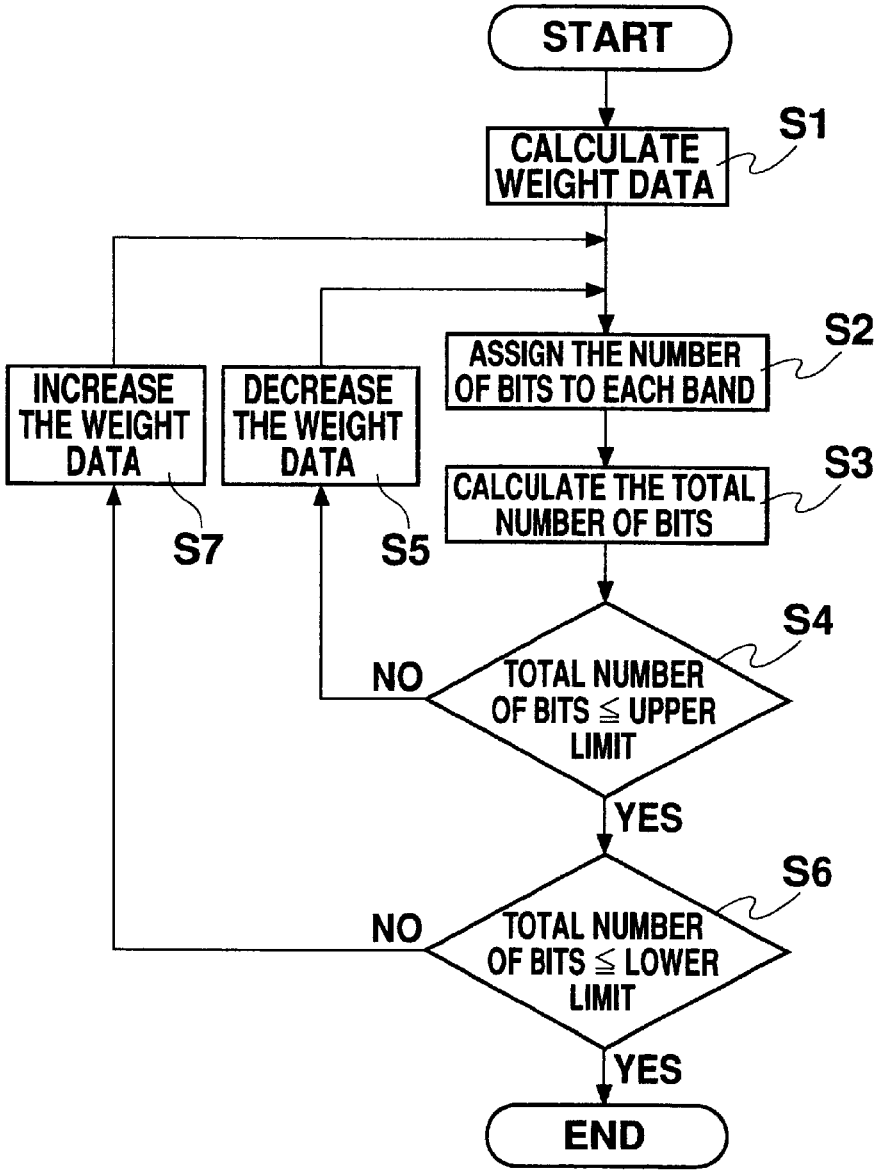
FIG. 1 is a flowchart showing how digital data is coded in the present invention.

FIG. 1 is a flowchart showing a digital data coding method according to a first embodiment of the present invention. This flowchart shows only the steps from the start to the number-of-bits data generation step. In actual coding processing, band data is coded based on the generated number-of-bits data.

Figure 8:
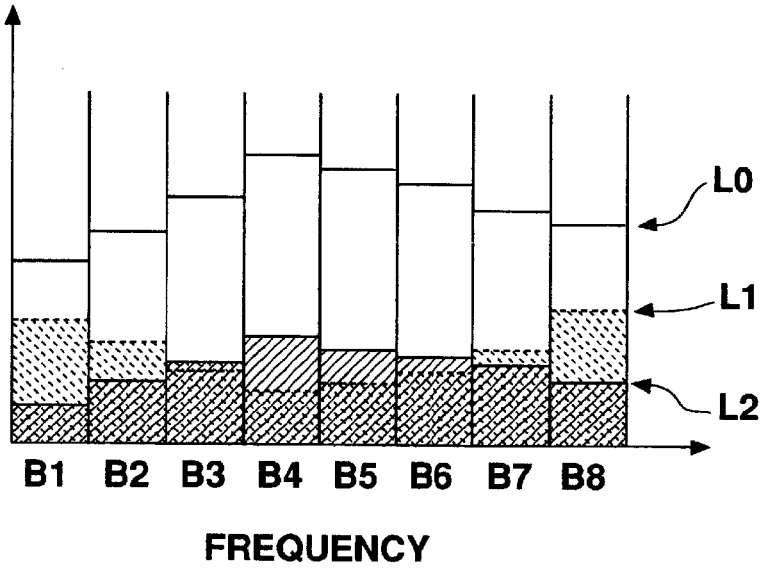
Fig. 8 PRIOR ART
FIG. 8 is a diagram showing input data X(n) divided into bands.

In step S1, the method calculates weight data gm(n)for each piece of band data Am(n)generated by dividing a block of data into a plurality of pieces. The weight data represents the importance of each band. This weight data gm(n) is determined according to how easy it is for a human ear to hear audio signals, generated from band data Am(n)for playback. More specifically, the weight data gm(n) is generated according to the difference between the lowest audible level L1 or the masking level L2, whichever is higher, and the signal level L0 of band data Am(n), as shown in FIG. 8. The importance of each band is represented by a predetermined number of bits (for example, four bits).

In step S2, the method assigns to each band a number of bits for coding band data Am(n)according to the weight data gm(n) generated in step S1. To do so, the method uses a ROM table, containing number-of-bits data Wm(n), to convert the weight data gm(n) to the corresponding number-of-bits data Wm(n). In step S3, the method adds up the number of bits assigned to the bands assigned in step S2 to get the total number of bits required to code one block of band data Am(n). That is, the method adds up number-of-bits data Wm(n) for one block of data and generates total data S(n) required to code one block of band data Am(n).

In step S4, the method checks if the total number of bits S(n), calculated in step S3, is equal to or less than the upper limit of the target range. If the total number of bits is greater than the upper limit, control proceeds to step S5; otherwise, control continues on to step S6. In step S5, the method subtracts a predetermined value from the weight data gm(n), generated in step S1, to update it and passes control back to step S2.

In step S6, the method checks if the total number of bits S(n), calculated in step S3, has reached the lower limit of the target range. If the total number of bits S(n) has not yet reached the lower limit, control goes to step S7; otherwise, processing ends. In step S7, the method adds a predetermined value to the weight data gm(n), generated in step S1, to update it and passes control back to step S2. Upon completion of the steps described above, the number-of-bits data Wm(n), as well as the number of bits required to code the band data Am(n), is determined.

The following describes an example of coding steps described above. In the following description, it is assumed that band data Am(n) is divided into four bands, B1 to B4, and that the weight data gm(n) consists of four bits, 0–3. In other words, the weight data gm(n) uses four bits to represent 0–15.

FIG. 2 shows an example of the conversion table used in step S2 for converting weight data gm(n) to number-of-bits data Wm(n). In this table, weight data gm(n) is divided into four levels with the number of bits assigned to each. Assume that, in step S1, the initial values of weight data, g1(n)–g4(n), corresponding to bands B1–B4, are calculated as "4", "5","9", and "10", respectively, as shown in FIG. 3. In step S2, the initial values of number-of-bits data W1(n)–W4(n), corresponding to weight data g1(n)–g4(n), are determined according to the conversion table shown in FIG. 2. That is, the initial values of number-of-bits data W1(n)–W4(n) are "1", "1", "2", and "2". In step S3, the total number of bits S(n) of number-of-bits data W1(n)–W4(n), or "1", "1", "2", and "2", is calculated as "6". If the upper limit of the target range is "5", then the total number of bits S(n) exceeds the upper limit. So, in step S5, "1" is subtracted from each of weight data g1(n)–g4(n). The result is that weight data is "3", "4", "8", "9", respectively. Conversion is performed again on this updated number-of-bits data W1(n)–W4(n), or "3", "4", "8", and "9", using the conversion table shown in FIG. 2. The new number-of-bits data W1(n)–W4 (n) is "0", "1", "2", and "2". The total number of bits S(n) of this new number-of-bits data W1(n)–W4(n), or "0", "1", "2", and "2", is "5". This does not exceed the upper limit. Assume that the lower limit is also "5". Then, in step S6, it is determined that the total number of bits S(n) has reached the lower limit. Therefore, the number-of-bits data W1(n)–W4 (n) is determined as "0", "1", "2", and "2".

Next, a representative conventional coding method will be compared with the coding method according to the present invention. Rather than reducing the weight assigned to each band, the conventional method reduces the number of bits assigned to each band to keep the total number of bits within the target range.

The conventional method subtracts "1" from each of the number-of-bits data W1(n)–W4(n), or "1", "1", "2", and "2". The resulting new number-of-bits data W1(n)–W4(n) is "0", "0", "1", and "1". Therefore, the total of number-of-bits data W1(n)–W4(n), or "0", "0", "1", and "1", is "2", which is lower than the upper limit of "5". This means that three bits, though available for use, are not used. As compared with the method according to the present invention, it is apparent that the conventional method prevents the bits from being fully utilized.

Figure 4:
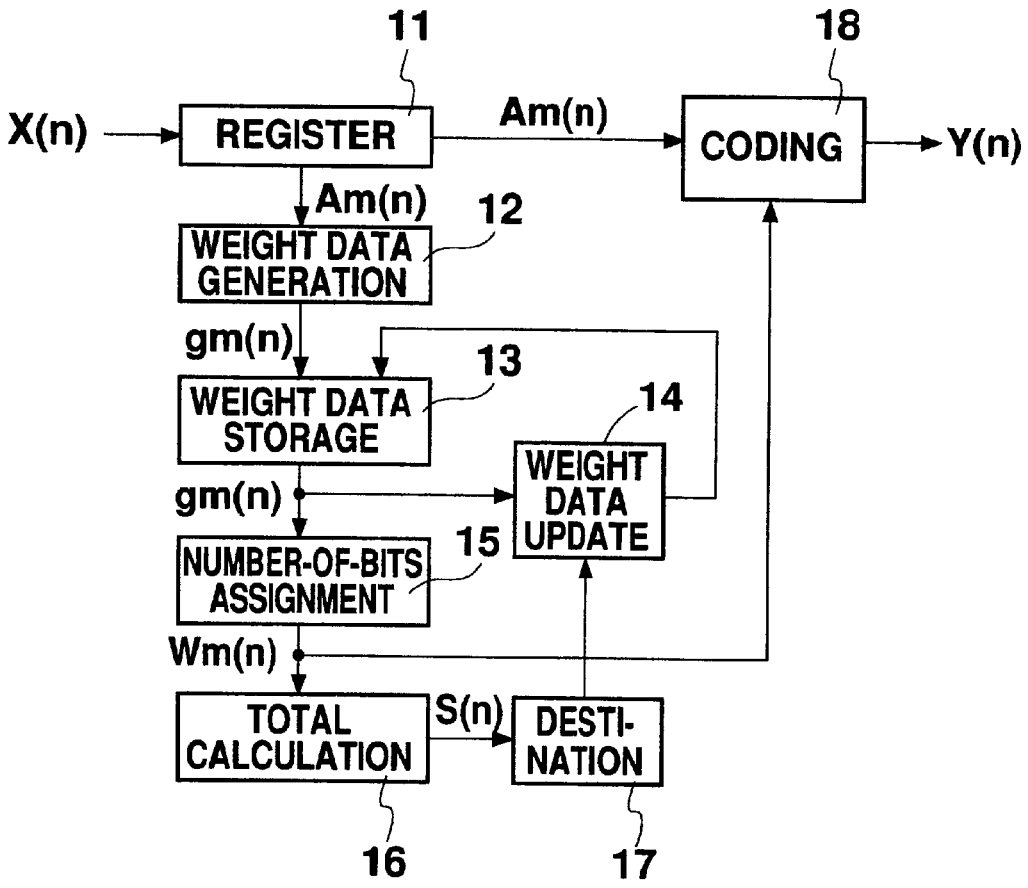
FIG. 4 is a block diagram showing a first embodiment of a digital data coding apparatus according to the present invention.

FIG. 4 is a block diagram showing a first embodiment of a digital data coding apparatus according to the present invention.

Figure 7:
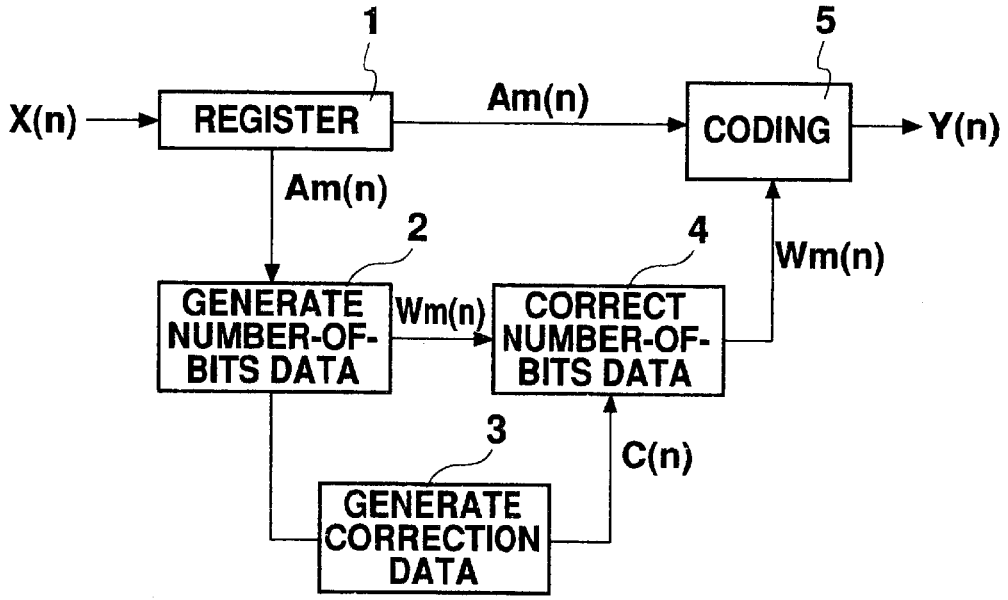
Fig. 7 PRIOR ART
FIG. 7 is a block diagram showing the configuration of a conventional digital data coding apparatus.

A register 11, similar to the register 1 in FIG. 7, receives input data X(n). The data is output from the register 11, one piece of band data Am(n) at a time. A weight data generation circuit 12 calculates the weight data gm(n)for each piece of band data Am(n) received from the register 11. Basically, the weight data generation circuit 12 generates this weight data gm(n) according to the same criterion used by the number-of-bits data generation circuit 2 in FIG. 2, except that more bits are used for the weight data than for representing the number of bits. For example, two bits (4 levels) are used to represent the number of bits for coding band data Am(n), while four bits (16 levels) are used to represent weight data gm(n).

A weight data storage circuit 13 stores at least one block of weight data gm(n)generated by the weight data generation circuit 12. A weight data update circuit 14 increases or decreases the weight data gm(n), read from the weight data storage circuit 13, by a predetermined value in response to an instruction from a determination circuit 17 which will be described later. The weight data update circuit 14 then stores the new weight data gm(n) back into the weight data storage circuit 13, updating the weight data gm(n) stored in the weight data storage circuit 13. A number-of-bits assignment circuit 15 generates number-of-bits data Wm(n) specifying the number of bits in response to the weight data gm(n) received from the weight data storage circuit 13. That is, the number-of-bits assignment circuit 15 has a conversion table, such as the one shown in FIG. 2, to convert 4-bit weight data gm(n) to 2-bit number-of-bits data Wm(n).

A total calculation circuit 16 calculates the total number of bits of the number-of-bits data Wm(n)for each block received from the number-of-bits assignment circuit 15. It generates the total number of bits S(n) required to code one block of band data Am(n). To determine whether the total number of bits S(n) is within the desired range, the determination circuit 17 compares the total number of bits S(n) with the upper limit and with the lower limit. These limits are set considering the compression target value. The compression target value, which is set corresponding to the compression ratio, determines the total number of bits of one block of compressed image data Y(n) which will be generated. When the total number of bits S(n) exceeds the upper limit, the determination circuit 17 directs the weight data update circuit 14 to decrease the value of the weight data gm(n). On the other hand, when the total number of bits S(n) has not reached the lower limit, the determination circuit 17 tells the weight data update circuit 14 to increase the value of the weight data gm(n). When the total number of bits S(n) does not exceed the upper limit and has reached the lower limit, the determination circuit 17 does not update the weight data gm(n); in this case, the current number-of-bits data Wm(n) is determined. The determination circuit 17 increases or decreases the value the weight data update circuit 14 is add to, or subtract from, the weight data gm(n) according to the difference between the total number of bits S(n) and the upper value or the lower value. That is, when the difference between the total number of bits S(n) and the upper limit is greater, the subtraction value will also be greater, while the addition value increases along with the difference between the total number of bits S(n) and the lower limit. This, in turn, decreases the number of times the weight data update circuit 14 must update weight data gm(n).

A coding circuit 18, similar to the coding circuit 5 shown in FIG. 7, codes band data Am(n) received from the register 11 according to the number-of-bits data Wm(n) sent from the number-of-bits assignment circuit 15. This coding method codes band data Am(n) according to the updated and optimized number-of-bits data Wm(n), eliminating wasteful bits.

Figure 5:
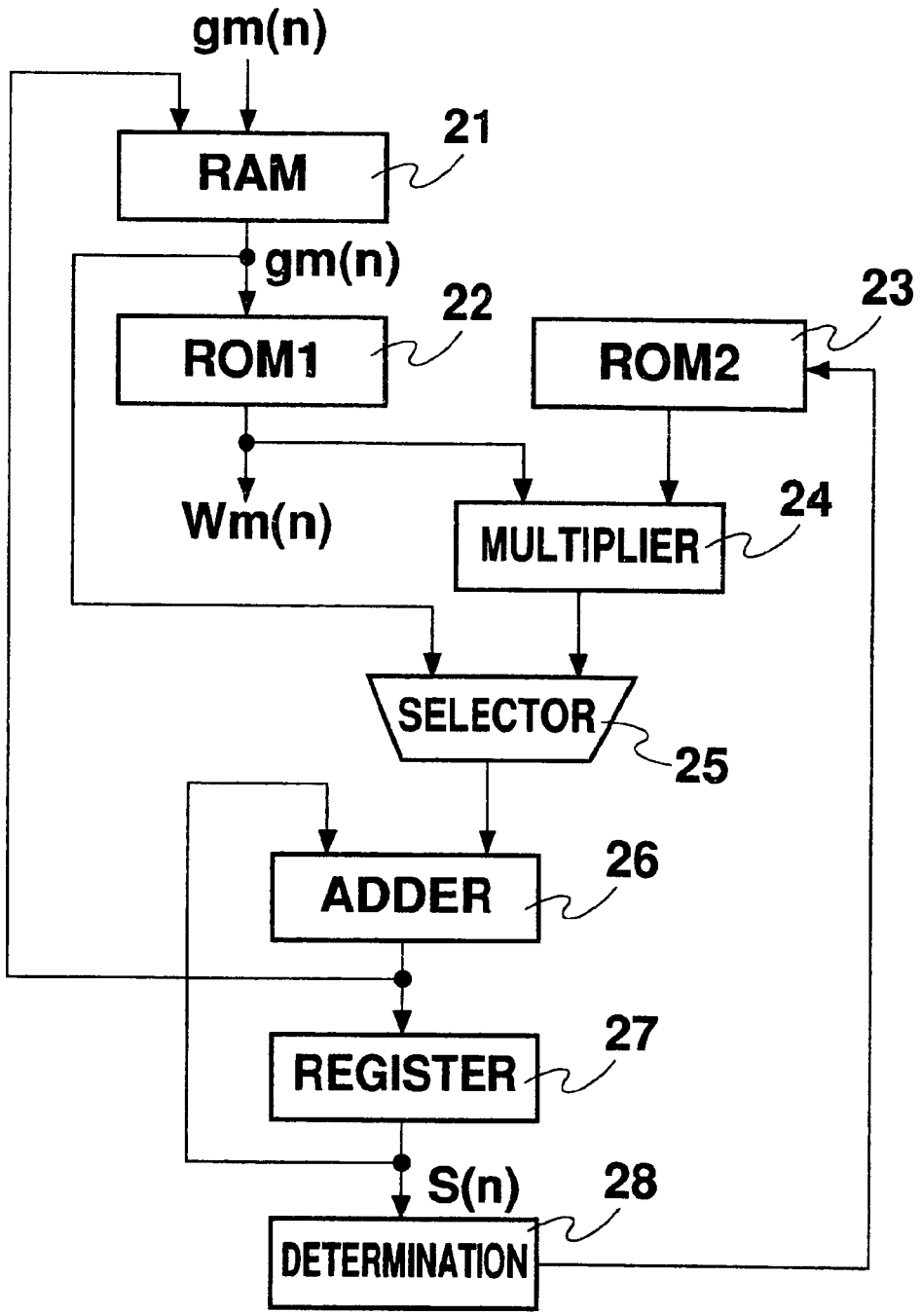
FIG. 5 is a block diagram showing a second embodiment of the digital data coding apparatus according to the present invention.

FIG. 5 is a block diagram showing a second embodiment of the digital data coding apparatus according to the present invention. This figure shows how optimized number-of-bits data Wm(n) is generated based on weight data gm(n). Weight data gm(n) is generated by the register 11 and the weight data generation circuit 12 shown in FIG. 4, and data is coded by the coding circuit 18 shown in FIG. 4.

A RAM 21 receives and stores at least one block of weight data gm(n). A first ROM 22 has a conversion table for converting weight data gm(n) to number-of-bits data Wm(n). It receives weight data gm(n) from the RAM 21 and outputs number-of-bits data Wm(n). A second ROM 23 contains (i) number-of-units data required to calculate the total number of bits and (ii) data to be added to, or to be subtracted from, weight data gm(n) during update. It selectively outputs one of the two types of data according to the processing to be performed.

A multiplier 24, connected to the first ROM 22 and the second ROM 23, multiples number-of-bits data Wm(n) by number-of-units data to calculate the total number of bits. When updating weight data gm(n), the multiplier 24 outputs data to be added to, or to be subtracted from, the weight data gm(n) unchanged. A selector 25, connected to the RAM 21 and multiplier 24, decides an output of the multiplier 24 when calculating the total number of bits or the RAM 21 when updating weight data gm(n). An adder 26, connected to the selector 25 and a register 27 which will be described later, adds data selectively read from the selector 25 to data stored in register 27. The register 27, connected to the adder 26, stores the result of the adder 26. The adder 26 and the register 27 work together to accumulate the added result. In addition, the output from the adder 26 is sent to the RAM 21 to allow weight data gm(n) to be updated and written into the RAM 21.

A determination circuit 28 obtains a value for the total number of bits S(n) obtained by accumulating the number-of-bits data Wm(n) and compares it with a predetermined criterion value to check if the total number of bits S(n)of a block is within the desired range. The operation of the determination circuit 28 is the same as that of the determination circuit 17 shown in FIG. 4. The determination circuit 28 also determines the amount of the next update to be applied to number-of-bits data Wm(n) and directs the second ROM 23 to specify data to be added to, or to be subtracted from, weight data gm(n) during update processing.

Figure 6:
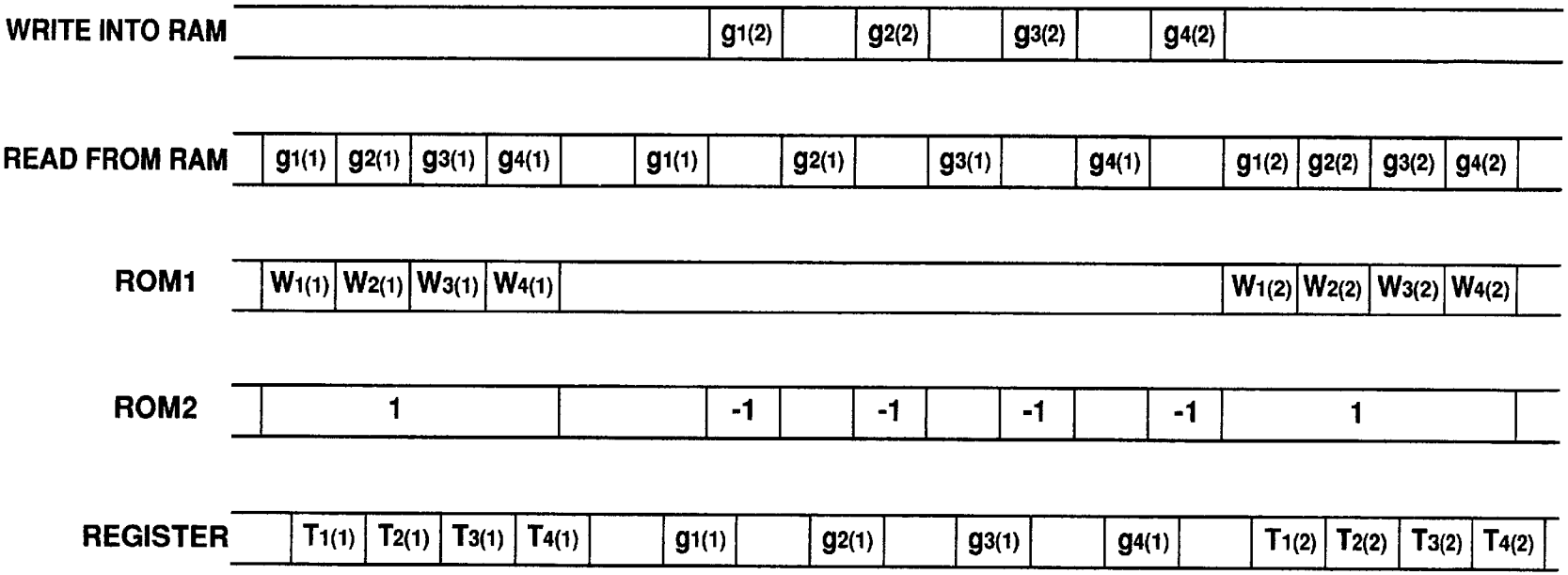
FIG. 6 is a timing chart describing the operation of the unit according to the second embodiment.

FIG. 6 is a timing chart of the coding apparatus shown in FIG. 5. This is the timing chart when one block is divided into four pieces of band data, A1(n)–A4(n).

When the RAM 21 contains four weight data values, g1(1)–g4(1) and weight data g1(1)–g4(1) is read and sent to the first ROM 22, one value at a time, number-of-bits data W1(l)–W4(1) corresponding to weight data g1(l)–g4(1) is generated according to the conversion table. When the multiplier 24, selected by the selector 25, receives the number-of-bits data W1(1)–W4(1) from first ROM 22 and the number-of-units data "1" from the second ROM 23, it calculates the product. This product, or the number-of-bits data W1(1)–W4(1), is accumulated by the adder 26 and the register 27.

In the initial state, the register 27 is reset to zero and therefore the following number-of-bits data W1(1) is set in the adder 26 first:

$$T1(1)=W1(1)$$

This is stored directly into the register 27. Then, number-of-bits data, W2(1)–W4(1), is sent to the adder 26, one at a time. These values are accumulated in the register 27 as follows:

$$T2(1)=T1(1)+W2(1)$$

$$T3(1)=T2(1)+W3(1)$$

$$T4(1)=T3(1)+W4(1)$$

Finally, the following accumulated value is stored in the register 27:

$$T4(1)=W1(1)+W2(1)+W3(1)+W4(1)$$

This value is sent to the determination circuit 28 as the total number of bits S(1).

Assume that the total data S(1) is large and therefore the determination circuit 28 requests that each piece of the weight data, g1(1)–g4(1), be decremented by 1. At this time, the selector 25 is switched to the RAM 21 with the register 27 reset to zero. The add/subtract value of "−1" is sent from the second ROM 23

The weight data g1(1) is read from the RAM 21 again and, via the selector 25 and adder 26, stored in the register 27. Then, the selector 25 is switched to the multiplier 24 and the add/subtract value of −1, read from the second ROM 23, is sent to the adder 26. The add/subtract value of −1 is added to the weight data g1(1) as follows:

$$g1(2)=g1(1)-1$$

This weight data g1(2) is written into the RAM 21. Likewise, the following weight data g2(2)–g4(2) is written into the RAM 21:

$$g2(2)=g2(1)-1$$

$$g3(2)=g3(1)-1$$

$$g4(2)=g4(1)-1$$

Then, the updated weight data g1(2)–g4(2), read from the RAM 21, i s converted to number-of-bits data W1(2)–W4(2) in the first ROM 22. As for the number-of-bits data W1(1)–W4(1), the adder 26 and the register 27 accumulate number-of-bits data W1(2)–W4(2). The following is sent to the determination circuit 28 as the total number of bits S(2):

$$T4(2)=W1(2)+W2(2)+W3(2)+W4(2)$$

In a second embodiment of the present invention, the selector 25 causes the adder 26 to perform two types of processing: accumulation processing of number-of-bits data W1(n)–W4(n), and update processing of weight data g1(n)–g4(n). This reduces the number of adders, thus making the circuit more compact.

Repetition of the above operation updates the weight data g1(n)–g4(n) and keep s the total number of bits S(n) within a predetermined range. Therefore, by using the number-of-bits data W1(n)–W4(n) corresponding to the weight data weight data g1(n)–g4(n), band data A1(n)–A4(n) may be coded into compression data Y(n) with the number of bits of a block within a predetermined range.

In the embodiments described above, data X(n) is divided into a plurality of blocks according to the frequency before being sent to the register 11. Data may also be divided according to the time before being sent to the register 11.

When coding band data, the present invention allows the number of bits of each band to be determined more flexibly based on weight data. This means that optimizing the number of bits for each band enables data to be coded efficiently without generating wasteful bits.

While there have been described what are at present considered to be preferred embodiments of the present invention, it will be understood that various modifications may be made thereto, and it is intended that the appended claims cover all such modifications as fall within the true spirit and scope of the invention.

What is claimed is:

1. A digital data coding method for coding one block of digital data at a time, each block composed of a plurality of digital data values, each digital data value representing a value of a corresponding component, said digital data coding method comprising:

a first step for calculating specific weight data for each component;

a second step for assigning a number of bits to each component according to said weight data, wherein said number of bits corresponds to a plurality of weight data;

a third step for calculating a total of the number of bits of one block, the number of bits being assigned in said second step;

a fourth step for comparing between the total value of the number of bits of one block calculated in said third step with a predetermined aim value; and a fifth step for increasing or decreasing said weight data calculated in said first step according to the comparison in said fourth step, wherein, by repeating said first step to said fifth step, the total number of bits of one block is converged into a predetermined range, wherein said weight data is repeatedly increased or decreased with repeating said first step to said fifth step.

2. The digital data coding method according to claim 1, wherein, in said fifth step, said weight data is increased or decreased according to a difference between said total value and said aim value.

3. The digital data coding method according to claim 1, wherein, in said second step, the number of bits is assigned according to a predetermined table containing a correspondence between the weight data and the number of bits.

4. A digital data coding apparatus coding digital data in block units, each block comprising a plurality of digital data values, each value of digital data representing a value of a corresponding component, said digital data coding apparatus comprising:

a weight data generation circuit calculating specific weight data for each component, said weight data representing an importance of the component;

a weight data storage circuit storing at least one block of said weight data;

a number-of-bits assignment circuit assigning a number of bits to each component according to said weight data stored in said weight data storage circuit, said number of bits corresponds to a plurality of weight data;

a total calculation circuit calculating a total value of the number of bits of one block; and a weight data update circuit comparing the calculated total value of the number of bits of one block with a predetermined aim value and increasing or decreasing said weight data, stored in said storage circuit, according to the comparison, wherein, by repeating an update of said weight data, said digital data coding apparatus converges the total number of bits of one block into a predetermined range and codes the digital data using the total number of bits.

5. The digital coding apparatus according to claim 4, wherein said weight data update circuit increases or decreases said weight data according to a difference between said total number calculated by total calculation circuit and said target value.

6. The digital data coding apparatus according to claim 4, wherein the weight data to be increased or decreased is a fixed value.

7. The digital data coding apparatus according to claim 4, wherein the number-of-bits assignment circuit assigns the number of bits according to a predetermined table containing a correspondence between the weight data and the number of bits.

* * * * *